US009732721B2

(12) United States Patent
Chen et al.

(10) Patent No.: US 9,732,721 B2
(45) Date of Patent: Aug. 15, 2017

(54) CRANKSHAFT ROTATING ANGLE CONTROLLING SYSTEM FOR CONTROLLING CRANKSHAFT ROTATING ANGLE AND CRANKSHAFT ROTATING ANGLE CONTROLLING METHOD FOR CONTROLLING THE SAME

(71) Applicant: INDUSTRIAL TECHNOLOGY RESEARCH INSTITUTE, Hsinchu (TW)

(72) Inventors: Pin-Yung Chen, Hsinchu (TW); Chin-Hone Lin, Hsinchu (TW); Wen-Yen Chen, Hsinchu (TW); Shin-Hsiang Chien, Hsinchu (TW); Ta-Chuan Liu, Hsinchu (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 12 days.

(21) Appl. No.: 14/836,421

(22) Filed: Aug. 26, 2015

(65) Prior Publication Data

US 2016/0131100 A1 May 12, 2016

(30) Foreign Application Priority Data

Nov. 11, 2014 (TW) ..... 103138999 A

(51) Int. Cl.
*F02N 19/00* (2010.01)
*F02D 41/00* (2006.01)
(Continued)

(52) U.S. Cl.
CPC ..... *F02N 19/005* (2013.01); *F02D 41/009* (2013.01); *F02D 41/042* (2013.01);
(Continued)

(58) Field of Classification Search
CPC .. F02N 19/005; F02N 11/04; F02N 2019/008; F02D 41/009; F02D 41/042; F02D 2041/0095; F02D 2250/24
(Continued)

(56) References Cited

U.S. PATENT DOCUMENTS 4,774,464 A 9/1988 Kubota et al.
4,792,788 A 12/1988 Kumar
(Continued)

FOREIGN PATENT DOCUMENTS

TW 575716 B 2/2004
TW 200409865 A 6/2004
TW 201339413 A 10/2013

OTHER PUBLICATIONS

Yanagisawa et al., Development of Idling Stop System for 125 cm3 Scooters with Fuel Injection; SAE International; Sep. 28, 2010.
(Continued)

*Primary Examiner* — Mahmoud Gimie
(74) *Attorney, Agent, or Firm* — Rabin & Berdo, P.C.

(57) ABSTRACT

A crankshaft rotating angle controlling method and a crankshaft rotating angle controlling system are provided. A shut-off signal is obtained, and an engine speed is judged. If the engine speed is lower than a specific value, a generator is set in a driving mode at an ending point of a missing tooth signal in a gear pulse signal, such that the generator in the driving mode drives a crankshaft to exceed a top-dead-center of a cylinder. When the crankshaft arrives at a bottom-dead-center of the cylinder, the generator is set to be in a holding mode of an error phase of a three-phase current. Through the generator in the driving mode, the given error phase of the three-phase current stops the generator immediately and the crankshaft is fixed within an angle range of a default stop position.

25 Claims, 4 Drawing Sheets

(51) Int. Cl.
*F02D 41/04* (2006.01)
*F02N 11/04* (2006.01)

(52) U.S. Cl.
CPC .. *F02D 2041/0095* (2013.01); *F02D 2250/24* (2013.01); *F02N 11/04* (2013.01); *F02N 2019/008* (2013.01)

(58) Field of Classification Search
USPC ..... 123/179.28
See application file for complete search history.

(56) References Cited

U.S. PATENT DOCUMENTS

| | | | | |
|---|---|---|---|---|
| 6,718,929 | B2 * | 4/2004 | Onozawa | F01L 1/053 123/182.1 |
| 6,859,002 | B2 | 2/2005 | Desbiolles et al. | |
| 7,249,527 | B2 | 7/2007 | Desbiolles | |
| 7,415,350 | B2 | 8/2008 | Nishikiori | |
| 8,688,359 | B2 | 4/2014 | Kuniyoshi et al. | |
| 2003/0172893 | A1 * | 9/2003 | Ackermann | F02N 19/004 123/179.5 |
| 2004/0255904 | A1 * | 12/2004 | Izawa | B60K 6/445 123/352 |
| 2007/0204827 | A1 * | 9/2007 | Kishibata | F02N 11/08 123/179.5 |
| 2009/0248282 | A1 | 10/2009 | Adachi | |

OTHER PUBLICATIONS

Oriyama et al., Development of idling stop system for scooter; Masayuki Toriyama, Toru Iwadate, Tomomi Yuhara, Hiroyuki Shinmura; Technical Notes/JSAE Review; Jan. 2001; pp. 92-94.

Jain et al., Intergrated Starter Generator for 42-V Powernet Using Induction Machine and Direct Torque Control Technique; IEEE, Shashidhar Mathapati, V. T. Ranganathan, Senior Member, IEEE, and V. Narayanan; IEEE Transactions on Power Electronics; Mar. 2006; pp. 701-710.

Reshenikov, Analysis of Integrated Starter-Generator Operation on a Mathematical Model; EUROCON 2007 The international Conference on Computer as a Tool; Sep. 9, 2007; pp. 2757-2760.

Zhang et al., A Direct-Flux-Vector-Controlled Induction Generator With Space-Vector Modulation for Integrated Starter Alternator; IEEE, and Muhammed Fazlur Rahman, Senior Member, IEEE; IEEE Transactions on Industrial Electronics; Oct. 2007; pp. 2512-2520.

Rizzoni et al., Crankshaft position measurement for engine testing, control, and diagnosis; ehicular Technology Conference, 1989, IEEE 39th; 1989; pp. 423-436.

* cited by examiner

CRANKSHAFT ROTATING ANGLE CONTROLLING SYSTEM FOR CONTROLLING CRANKSHAFT ROTATING ANGLE AND CRANKSHAFT ROTATING ANGLE CONTROLLING METHOD FOR CONTROLLING THE SAME

CROSS-REFERENCE TO RELATED APPLICATIONS

This application claims priority to Taiwanese Application Serial No. 103138999, filed on Nov. 11, 2014. The entirety of the above-mentioned patent application is hereby incorporated by reference herein and made a part of this specification.

BACKGROUND

1. Technical Field

This disclosure relates to crankshaft rotating angle controlling methods and crankshaft rotating angle controlling systems, and, more particularly, to a crankshaft rotating angle controlling method and a crankshaft rotating angle controlling system that reduce an engine starting torque of an integrated starter generator.

2. Description of Related Art

When an integrated starter generator (ISG) that uses a permanent magnetism design is applied to an idling turning off function, a speed of an engine from a rest state to an ignition state cannot be accomplished unless a torque is great enough. In particular, when the engine stops and a piston is just located around a top-dead-center of a compression stroke, an even greater starting torque is needed for starting the engine the next time. Therefore, the ISG has to drive a crankshaft of the engine to exceed the starting torque of the top-dead-center of the compression stroke, in order to start the engine and ensure that the speed is high enough for an ignition process to be performed successfully. In order to generate this great starting torque, the engine will suffer from a great torque for a long time. Therefore, the ISG has to be designed to have a large torsional moment, and comprise additional magnets and power components. A battery also has to provide a great current, which consumes power, and affects the life of the battery.

In order to ensure that the engine has a great torque to overcome the starting torque problem, an engine with a reduced compression device is brought to the market. The engine, when stopped, reverses a crankshaft to deduce the torque. When the engine is turned off and stops completely, a motor is controlled to drive the crankshaft of the engine to reverse, until the engine stops at a non-compression stroke. Therefore, when the engine closed the next time, a piston, before arriving the compression stroke, can be accelerated sufficiently to obtain great enough an inertia force. Such an inertia force, if combined with the driving torque of the engine, will exceed the starting torque, such that the piston can exceed the compression stroke.

However, the above techniques do not drive the motor to change the position of the crankshaft until the engine stops. As a result, additional energy is consumed. Since the motor is not driven until the engine stops, the motor will still vibrate suddenly, which make users uncomfortable.

Therefore, how to provide a crankshaft rotating angle controlling method and a crankshaft rotating angle controlling system that can reduce an engine starting torque is becoming an important issue in the art.

SUMMARY

A controlling method of crankshaft rotating angle applied to an engine is provided, comprising: obtaining a shut-off signal, and obtaining a top-dead-center and a bottom-dead-center of a crankshaft of the engine according to a gear pulse signal and a top-dead-center judging signal of the engine; judging whether an engine speed of the engine is lower than a specific value, and setting a generator of the engine in a driving mode at an ending point of a missing tooth signal in the gear pulse signal if the engine speed is lower than the specific value; and setting the generator in a standby mode according to the top-dead-center judging signal, judging if the crankshaft arrives at the top-dead-center, and setting the generator in a holding mode when the crankshaft further arrives at the bottom-dead-center.

A controlling system of crankshaft rotating angle comprises: an engine that provides a gear pulse signal and a top-dead-center judging signal; a generator that provides three-phase Hall signals; a vehicle control unit that provides a shut-off signal; and a driving controller connected to the engine, the generator and the vehicle control unit, the driving controller comprising: a pulse width modulation unit; a power signal gate that controls the pulse width modulation unit to control a current output from a battery; and a calculating unit for receiving the shut-off signal, the top-dead-center judging signal, the gear pulse signal and the three-phase Hall signals, so as to obtain a top-dead-center and a bottom-dead-center of a crankshaft of the engine according to the gear pulse signal and the top-dead-center judging signal. Moreover the power signal gate is opened as the crankshaft reaches the top-dead-center. What is more, the power signal gate is closed as the crankshaft reaches the bottom-dead-center and make the pulse width modulation unit change the sequence of the three-phase Hall signals to secure the crankshaft in position.

BRIEF DESCRIPTION OF DRAWINGS

The disclosure can be more fully understood by reading the following detailed description of the preferred embodiments, with reference made to the accompanying drawings, wherein.

DETAILED DESCRIPTION

Figure 1:
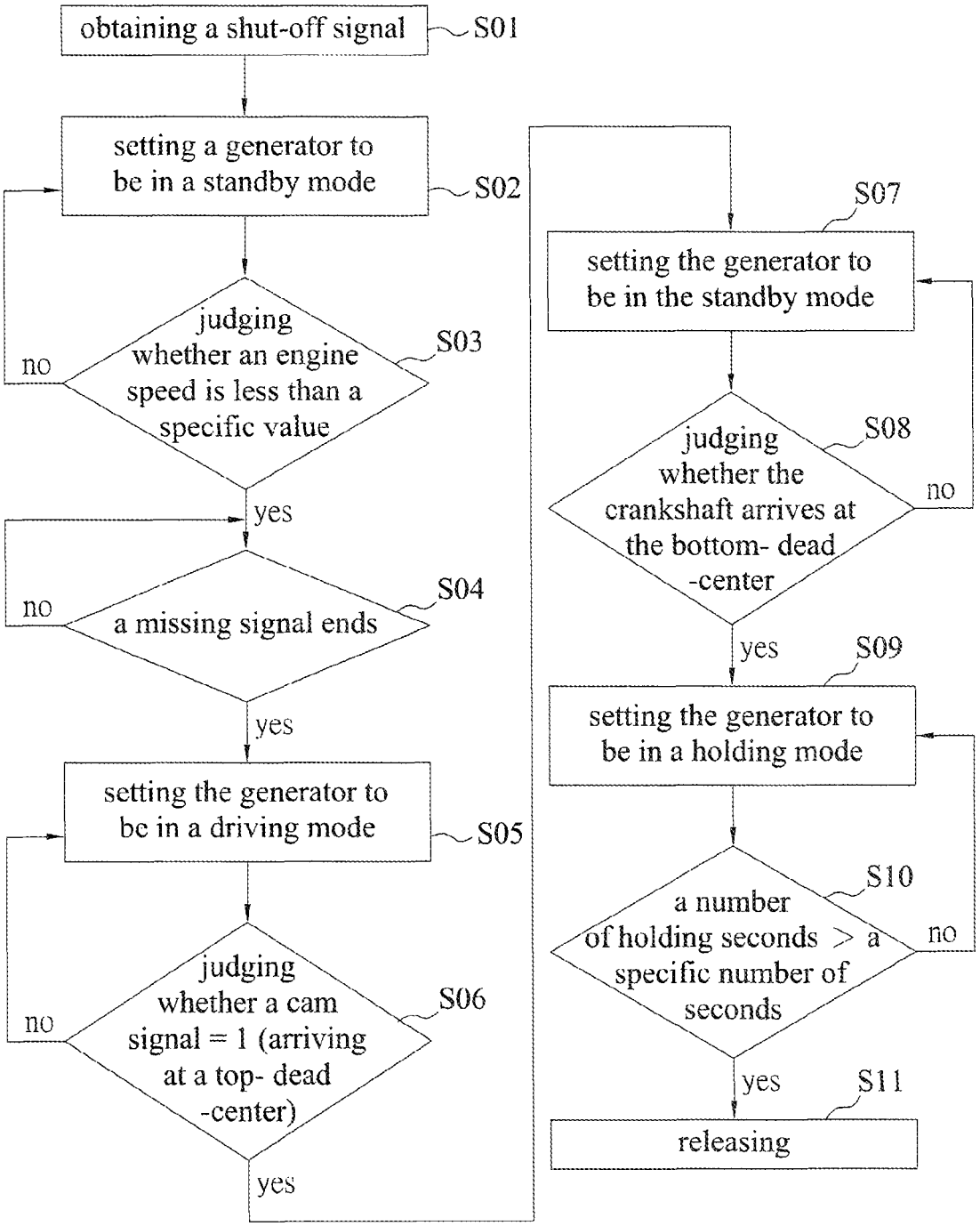
FIG. 1 is a flow chart of a controlling method of crankshaft rotating angle according to the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
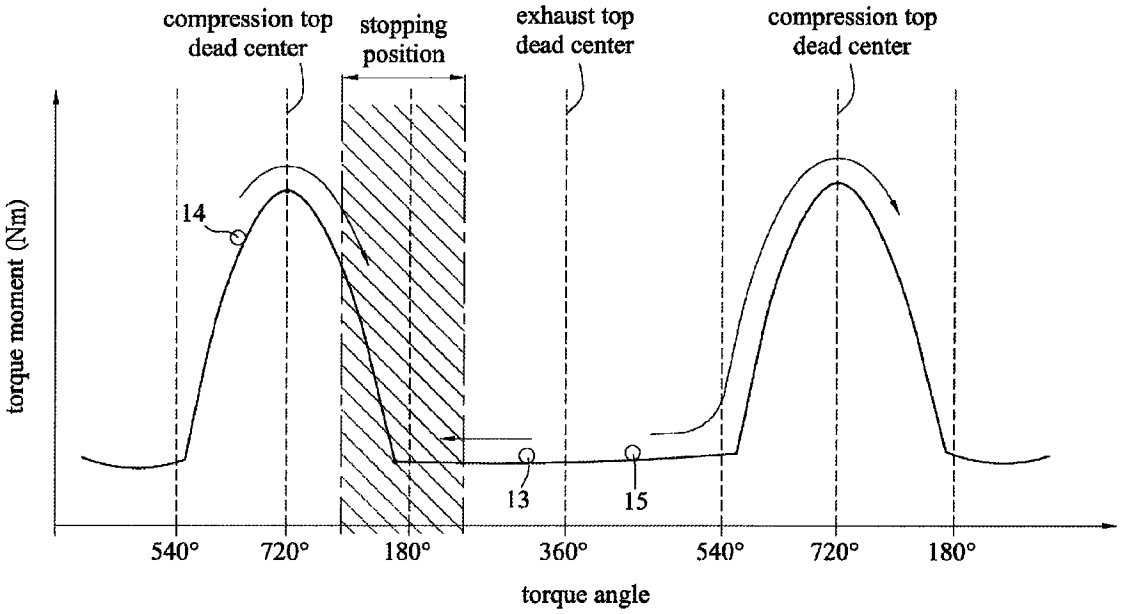
FIG. 2 illustrates the relation between a torque and a angle of a crankshaft of the controlling method.

In a crankshaft rotating angle controlling method according to the present disclosure, when an engine is turned off, a crankshaft is driven to exceed a top-dead-center and fixed to a bottom-dead-center, as shown in FIG. 2. After dynamic points 14 and 15 of the crankshaft according to the present disclosure are driven and exceed a compression top-dead-center, the crankshaft stops at a stopping position. By contrast, in the prior art when the crankshaft stops at the stopping point 13, the crankshaft is controlled to reverse to a stopping position.

FIG. 1 is a flow chart of a controlling method of crankshaft rotating angle according to the present disclosure. The controlling method is applied to a idling turning off function of an engine. In an embodiment, the engine is an integrated starter generator (ISG), which means that an engine and a generator are co-axial.

In step S01, a shut-off signal is obtained. After the shut-off signal is obtained, the generator is set to be in a standby mode in step S02. The generator in the standby mode does not drive or generate power. Accordingly, a pulse width modulation is inactive, and a battery does not output a current.

Figure 3:
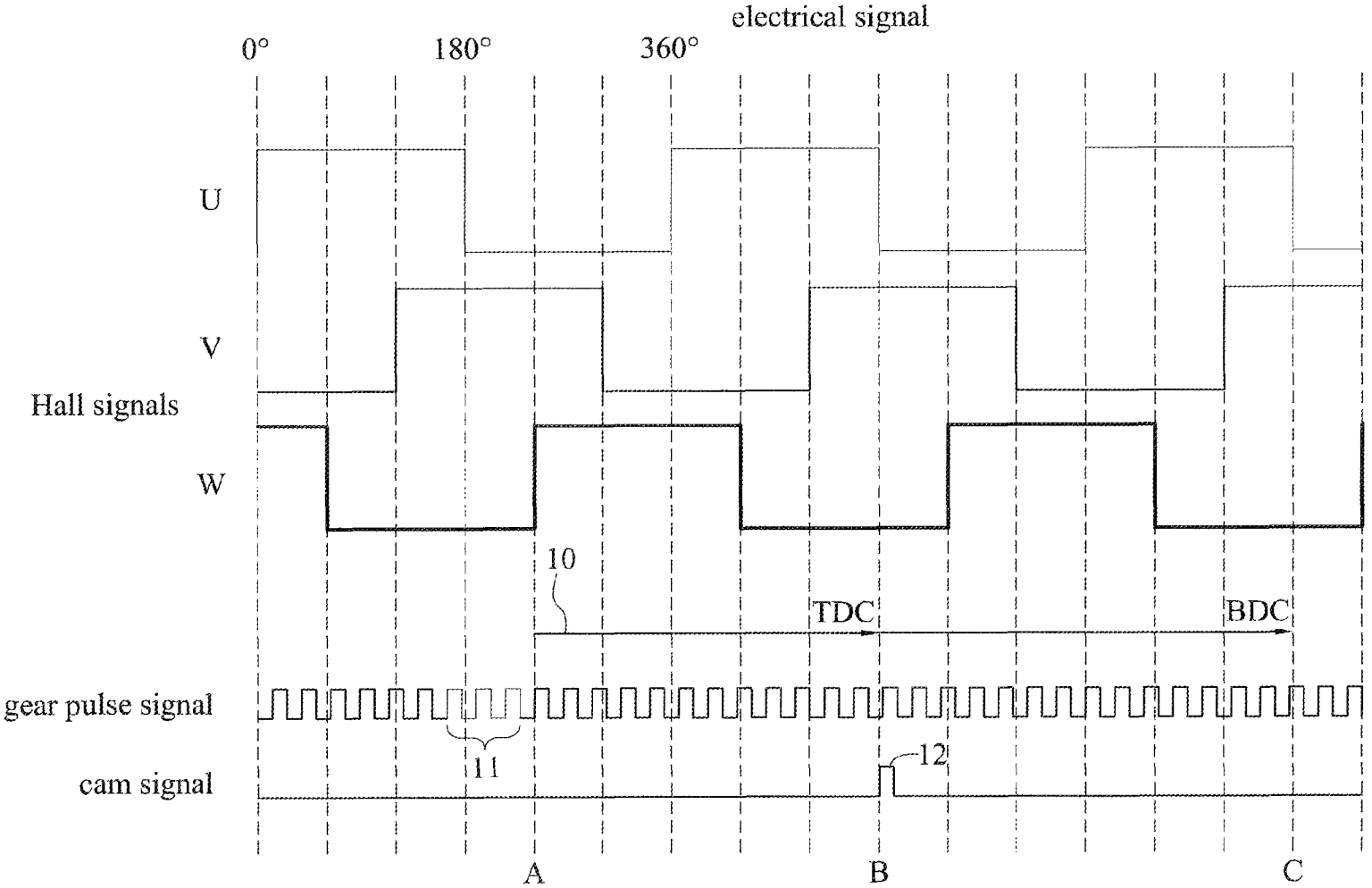
FIG. 3 illustrates the corresponding relation of three-phase Hall signals, a cam signal and a gear pulse signal according to the present disclosure.

When the shut-off signal is obtained, a gear pulse signal and a top-dead-center judging signal are also obtained from the engine. In an embodiment, the top-dead-center judging signal is a cam signal, a controller area network signal, a crankshaft rotating angle speed variation signal, a manifold absolute pressure sensor signal or an ignition current sensing signal. In the following embodiments, the top-dead-center judging signal is a cam signal, but the present disclosure is not limited thereto. As shown in FIG. 3, the gear pulse signal represents a mechanical angle position of the operating engine. The speed of the engine can be calculated through a time difference between two fixed gears. The gear pulse signal includes a missing tooth signal 11. The missing tooth signal 11 provides a time point for the engine to determine ignition. The cam signal includes a pulse signal 12. The pulse signal 12 provides the engine to determine whether the crankshaft is located in the compression top-dead-center, rather than located in the exhaust top-dead-center.

In an embodiment, a four-stroke single cylinder engine is exemplified, as shown in FIG. 2. The four-stroke includes an intake stroke, a compression stroke, a power stroke and an exhaust stroke. A torque maximum of the crankshaft between the compression stroke and the power stroke is a compression top-dead-center, an exhaust top-dead-center is between the exhaust stroke and the intake stroke, and a bottom-dead-center is between the end of the power stroke and the exhaust stroke. Refer to FIG. 3 again. When at the ending point (i.e., the point A) of the missing tooth signal 11 in the gear pulse signal, if the mechanical angle of the crankshaft further rotates forward for 120 degrees, that is, rotating forward in the gear direction 10, the piston of the engine is to arrive at the top-dead-center (TDC, i.e., the point B) between the compression stroke and the power stroke, and to be identified by the pulse signal 12 of the cam signal. If the mechanical angle of the crankshaft rotates forward for 180 degrees, the piston of the engine is to arrive at the bottom-dead-center (BDC, i.e., point C) between the power stroke and the exhaust stroke.

Therefore, the positions of the top-dead-center and the bottom-dead-center of the crankshaft of the engine can be obtained easily from the gear pulse signal and the cam signal of the engine. Besides the cam signal, the position of the top-dead-center of the crankshaft of the engine can also be obtained from the controller local network signal, the crankshaft rotating angle speed variation signal, the manifold absolute pressure sensor signal or the ignition current sensing signal.

In step S03, it is judged whether an engine speed is lower than a specific value. Step S03 is executed continuously until it is judged that the engine speed is lower than the specific value. When the engine speed is lower than the specific value, the ending point (i.e., point A) of the missing tooth signal 11 in the gear pulse signal sets the generator of the engine to be in the driving mode (steps S04 and S05). The battery in the driving mode provides a current to enable the crankshaft to operate continuously.

In an embodiment, the specific value is determined by a torque that the crankshaft can achieve or exceed the top-dead-center and remaining inertia of the engine speed from the specific value to zero. When the specific value is small, which indicates that the engine is close to a stopping state, the remaining inertia between the specific value to zero is also very small. On the contrary, when the specific value is large, which indicates that the engine still has some remaining inertia, the amount of the remaining inertia of the engine will be determined by the setting of the specific value. Accordingly, the amount of torque of the crankshaft that exceeds the top-dead-center and the amplitude of the current that the battery can provide are also determined by the setting of the specific value. If the inertia is large, the torque that rotates the crankshaft forward to achieve or exceed the top-dead-center is also small, and the battery can provide a small current. On the contrary, if the inertia is small, the torque that rotates the crankshaft forward to achieve or exceed the top-dead-center must be large, and the battery provides a large current accordingly. Therefore, the specific value can be set to have different values according to the model of the engine. In an embodiment, the specific value is not limited to a constant value.

In step S06, it is judged whether crankshaft arrives at the top-dead-center. The cam signal is used as an example. The pulse signal of the cam signal is used to judge whether the crankshaft arrives at the compression top-dead-center. If the crankshaft does not arrive at the top-dead-center, the generator is kept in the driving mode, and it is kept on judging whether the crankshaft arrives at the top-dead-center. On the contrary, if the crankshaft arrives at the top-dead-center, the generator is set to be in the standby mode (step S07). Besides the cam signal, the controller local network signal, crankshaft rotating angle speed variation signal, the manifold absolute pressure sensor signal or the ignition current sensing signal can also used to obtain the position of the top-dead-center of the crankshaft of the engine.

In step S08, it is judged whether the crankshaft arrives at the bottom-dead-center. If the crankshaft does not arrive at the bottom-dead-center, the generator is still in the standby mode, and it is kept on judging whether the crankshaft arrives at the bottom-dead-center. On the contrary, if the crankshaft further arrives at the bottom-dead-center, the generator is set to be in the holding mode (step S09), so as to fix the crankshaft in position.

In step S10, it is determined whether a number of seconds that the crankshaft is fixed in position, when the generator is in the holding mode, is greater than specific number of seconds. If the number of seconds is greater than the specific number of seconds, the holding force of the generator is released (step S11), that is changing the generator from the holding mode to the standby mode, to ensure that the generator is in the standby mode, and the crankshaft has entered the predetermined angle range, and does not move any longer. In an embodiment, the specific number of seconds can be set by a user.

In an embodiment, the top and bottom-dead-centers of the crankshaft of the engine are detected by converting a mechanical angle of the engine into an electrical angle of the generator. The electrical angle is used to control the position of the crankshaft of the engine. Referring to FIG. 3, three-phase Hall signals, including a U-phase, a V-phase and a W-phase, are provided, and the electrical angle of the crankshaft can thus be calculated.

The cam signal in the top-dead-center judging signal is used as an example. The three-phase Hall signals map to the gear pulse signal and the cam signal, as shown in the mapping relation shown in FIG. 3. The crankshaft at the ending point (point A) of the missing tooth signal 11 keeps rotating forward for a mechanical angle of 120 degrees, and arrives at the top-dead-center (point B), where the pulse signal 12 of the cam signal is generated. The crankshaft rotates forward for another mechanical angle of 180 degrees, and arrives at the bottom-dead-center (point C).

The 120 degree and 180 degree mechanical angles can be converted to the electrical angles of the generator, and control the position of the crankshaft. In an embodiment, a 14-pole integrated starting generator cooperated with a 60-tooth series is used as an example. The top and bottom-dead-center of the crankshaft can be calculated by the following formulas:

$$\text{top-dead-center}: \frac{14}{2} \times 120^\circ(\text{mechanical angle}) = 840^\circ(\text{electrical angle})$$

$$\text{bottom-dead-center}: \frac{14}{2} \times 180^\circ(\text{mechanical angle}) = 1260^\circ(\text{electrical angle})$$

Therefore, after an electrical angle of 840 degrees is driven, crankshaft arrives at the compression top-dead-center between the compression stroke and the power stroke, as shown in FIG. 2. After an electrical angle of 1260 degrees is further driven, the crankshaft arrives at the bottom-dead-center between the power stroke and the exhaust stroke. In an embodiment, the crankshaft does not stop at the bottom-dead-center exactly. The crankshaft only needs to be stay in a stopping area that exceeds the compression top-dead-center, and the position of the crankshaft will stop at the bottom-dead-center, as shown in FIG. 2. The ratio of the mechanical angle to the electrical angle can be inferred from the relation of the tooth series with the three-phase Hall signals. The angle resolution can be increased if the electrical angle is used to control the mechanical angle, to achieve the objective of precise controlling.

In an embodiment, when the generator is in the holding mode, an order of three-phase Hall signals is pulse width modulated for the magnetic fields of the generator to interlace temporarily. The pulse width modulated U, V and W Hall signals allow the crankshaft to rotate in a specific order. For example, the crankshaft rotates forward if U, V and W phases are provided, while the crankshaft rotates reversely if W, V and U phases are provided. However, if an order of error phases of the three-phase Hall signals is provided, e.g., U, W and V phases being provided subsequently, the magnetic fields of the generator interlace temporarily, and the crankshaft stops operating immediately, such that the objective of fixing the crankshaft can be achieved.

Figure 4:
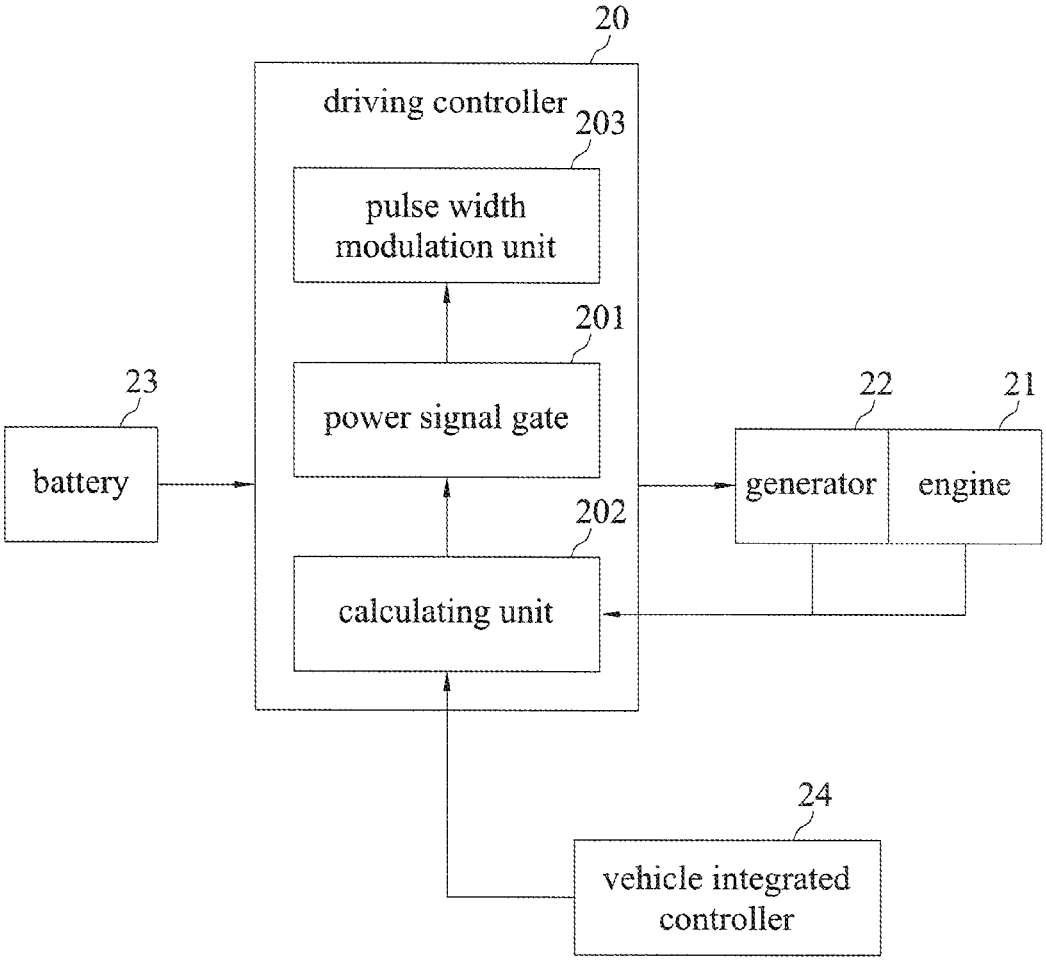
FIG. 4 is functional block diagram of a controlling system of crankshaft rotating angle according to the present disclosure.

As shown in FIG. 4, a crankshaft rotating angle controlling system is provided, which includes an engine 21, a generator 22, a battery 23, a vehicle control unit 24 and driving controller 20. The driving controller 20 is connected to the engine 21, the generator 22, the battery 23 and the vehicle control unit 24.

In an embodiment, the engine 21 and the generator 22 are co-axial, to form an integrated starter generator.

The engine 21 provides a gear pulse signal and a top-dead-center judging signal. The generator 22 uses a Hall sensor, a decoder or a resolver to provide a rotator position, i.e., providing three-phase Hall signals. The vehicle control unit 24 provides a shut-off signal. In an embodiment, the top-dead-center judging signal is a cam signal, a controller local network signal, a crankshaft rotating angle speed variation signal, a manifold absolute pressure sensor signal or an ignition current sensing signal.

The driving controller 20 includes a power signal gate 201, a pulse width modulation unit 203 and a calculating unit 202. The pulse width modulation unit 203 converts an analog signal into a pulse width modulation signal, and outputs the pulse width modulation signal. The power signal gate 201 controls the pulse width modulation unit 203, and controls a current output from the battery 23. In an embodiment, when the driving controller 20 opens the power signal gate 201, the pulse width modulation unit 203 is disabled, and the battery 23 does not output an current. When the driving controller 20 closes the power signal gate 201, the pulse width modulation unit 203 starts to operate, and the battery 23 outputs a current. Through the controlling of the power signal gate 201 by the driving controller 20, the pulse width modulation unit 203 is controlled, and the battery 23 outputs a current. In an embodiment, the battery 23 is a solar battery, a fuel battery or a secondary battery.

The calculating unit 202 receives the shut-off signal provided by the vehicle control unit 24, the gear pulse signal and the top-dead-center judging signal of the engine 21, and the three-phase Hall signals of the generator 22, and obtains the top-dead-center and the bottom-dead-center of the crankshaft of the engine 21 according to the gear pulse signal and the top-dead-center judging signal. The top-dead-center and the bottom-dead-center are obtained as described above, and further description thereto is omitted.

In an embodiment, when the calculating unit 202 receives the shut-off signal, the driving controller 20 is controlled to open the power signal gate 201, such that the pulse width modulation unit 203 is disabled, and the battery 23 does not output a current.

In an embodiment, the calculating unit 202, when the engine speed of the engine 21 is lower than a specific value, controls at an ending point of the missing tooth signal in the gear pulse signal the driving controller 20 to close the power signal gate 201, such that the pulse width modulation unit 203 is enabled, and the battery 23 outputs a current. The battery 23 outputs a current to the generator 22 and drive the crankshaft of the engine 21, to enable the crankshaft to arrive at or exceed the top-dead-center. The amplitude of the current can be determined by the specific value of the engine speed.

In an embodiment, the calculating unit 202, when the crankshaft arrives at the top-dead-center, controls the driving controller 20 to open the power signal gate 201, such that the pulse width modulation unit 203 is disabled, and the battery 23 does not output a current.

In an embodiment, the calculating unit 202, when the crankshaft arrives at the bottom-dead-center, controls the driving controller 20 to close the power signal gate 201, and controls the pulse width modulation unit 203 to change the order of the three-phase Hall signals, so as to fix the crankshaft in position. The order of the three-phase Hall signals is changed as described above, further description hereby omitted.

In an embodiment, the calculating unit 202, when the crankshaft is fixed in position, determines whether a number of seconds when the crankshaft is fixed is greater than a specific number of seconds. If the number of seconds is greater than the specific number of seconds, the pulse width modulation unit 203 is controlled to recover the order of the three-phase Hall signals, and the calculating unit 202 controls the driving controller 20 to open the power signal gate 201, such that the pulse width modulation unit 203 is disabled, and the battery 23 does not output a current. The crankshaft is not fixed in position due to the temporary interlacing of the magnetic fields of the generator 22, and enters the predetermined angle range, without moving any longer.

In sum, the controlling method and the controlling system according to the present disclosure, after obtaining the shut-off signal, which indicates that the engine is going to be turned off, set the generator to be in the standby mode. It is then judged whether the engine speed is lower than a specific value. When the engine speed is lower than the specific value, which means that the inertia still exists, the generator is set to be in the driving mode, and to provide a current to drive the crankshaft to arrive at or exceed the top-dead-center between the compression stroke and the power stroke. The generator is then set to be in the standby mode again. When the crankshaft arrives at the bottom-dead-center between the power stroke and the exhaust stroke, the generator is set to be in the holding mode, to fix the crankshaft at a position of a latter segment of the power stroke (when an exhaust valve is about to open). Therefore, even though the engine and the generator are not changed, the idling turning off function can be still achieved. Accordingly, the present disclosure has a low cost, solve the problem that the starting torque is too large when the engine is turned on, reduces driving power consumption by using inertia, and ensures that the engine, before and after stopping, can still operate smoothly.

Besides, the controlling method and the controlling system according to the present disclosure detect whether the crankshaft has arrive at the top-dead-center and the bottom-dead-center by the electrical angle of the generator that is converted by the mechanical angle of the engine. The angle resolution can be increased if the electrical angle is used to control the mechanical angle, to achieve the objective of precise controlling.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A crankshaft rotating angle controlling system, comprising:

an engine that provides a gear pulse signal and a top-dead-center judging signal;

a generator that provides three-phase Hall signals;

a vehicle control unit that provides a shut-off signal; and a driving controller connected to the engine, the generator and the vehicle control unit, further comprising:

a pulse width modulation unit;

a power signal gate for controlling an action of the pulse width modulation unit to control a current output from a battery; and a calculating unit for receiving the shut-off signal, the top-dead-center judging signal, the gear pulse signal and the three-phase Hall signals, so as to obtain a top-dead-center and a bottom-dead-center of a crankshaft of the engine according to the gear pulse signal and the top-dead-center judging signal, wherein the power signal gate is opened as the crankshaft reaches the top-dead-center, the power signal gate is closed after the crankshaft exceeds the top-dead-center and makes the pulse width modulation unit change a sequence of the three-phase Hall signals to secure the crankshaft in position.

2. The crankshaft rotating angle controlling system of claim 1, wherein the top-dead-center judging signal is a cam signal, a controller local network signal, a crankshaft rotating angle speed variation signal, a manifold absolute pressure sensor signal or an ignition current sensing signal.

3. The crankshaft rotating angle controlling system of claim 1, wherein the calculating unit closes the power signal gate at an ending point of a missing tooth signal in the gear pulse signal when an engine speed of the engine is lower than a specific value, so as to enable the battery to output a current to the generator and drive the crankshaft of the engine to achieve or exceed the top-dead-center.

4. The crankshaft rotating angle controlling system of claim 3, wherein the specific value is determined by a torque that the crankshaft can achieve or exceed the top-dead-center, and remaining inertia of the engine speed from the specific value to zero.

5. The crankshaft rotating angle controlling system of claim 1, wherein the engine and the generator are co-axial.

6. The crankshaft rotating angle controlling system of claim 1, wherein the top-dead-center is referred to a top-dead-center between a compression stroke and a power stroke.

7. The crankshaft rotating angle controlling system of claim 1, wherein the bottom-dead-center is referred to a bottom-dead-center between a power stroke and an exhaust stroke.

8. The crankshaft rotating angle controlling system of claim 1, wherein the generator uses a Hall sensor, a decoder or a resolver to provide the three-phase Hall signals.

9. The crankshaft rotating angle controlling system of claim 1, wherein the battery is a solar battery, a fuel battery or a secondary battery.

10. The crankshaft rotating angle controlling system of claim 1, wherein the calculating unit, when receiving the shut-off signal, controls the driving controller to open the power signal gate, such that the pulse width modulation unit is inactive, and the battery does not output a current.

11. The crankshaft rotating angle controlling system of claim 1, wherein the pulse width modulation unit converts an analog signal into a pulse width modulation signal and outputs the pulse width modulation signal, and the power signal gate controls the pulse width modulation unit to control the battery to output a current.

12. The crankshaft rotating angle controlling system of claim 1, wherein the calculating unit, when the crankshaft is fixed in position, determines whether a number of seconds when the crankshaft is fixed in position is greater than a specific number of seconds, and opens the power signal gate and initiates the pulse width modulation unit to recovery the order of the three-phase Hall signals when the number of seconds is greater than the specific number of seconds.

13. A crankshaft rotating angle controlling method, which is applicable to an engine, for controlling a crankshaft rotating angle, comprising:

obtaining shut-off signals, and then obtaining a top-dead-center and a bottom-dead-center of a crankshaft of the engine in accordance with a gear pulse signal and a top-dead-center judging signal of the engine;

judging whether an engine speed of the engine is lower than a specific value, if so, setting a generator of the engine in a driving mode at an ending point of a missing tooth signal in the gear pulse signal; and setting the generator in a standby mode according to the top-dead-center judging signal when the crankshaft arrives at the top-dead-center, and setting the generator in a holding mode to secure the crankshaft in position after the crankshaft further exceeds top-dead-center.

14. The crankshaft rotating angle controlling method of claim 13, wherein the top-dead-center judging signal is a cam signal, a controller local network signal, a crankshaft rotating angle speed variation signal, a manifold absolute pressure sensor signal or an ignition current sensing signal.

15. The crankshaft rotating angle controlling method of claim 14, wherein the top-dead-center and the bottom-dead-center of the crankshaft of the engine are detected by converting a mechanical angle of the engine into an electrical angle of the generator, identifying a position of the top-dead-center according to a pulse signal of the cam signal, and controlling a position of the crankshaft of the engine according to the electrical signal.

16. The crankshaft rotating angle controlling method of claim 15, wherein the electrical angle of the generator is calculated by three-phase Hall signals of the generator.

17. The crankshaft rotating angle controlling method of claim 13, further comprising, after obtaining the shut-off signal, setting the generator of the engine in the standby mode.

18. The crankshaft rotating angle controlling method of claim 13, wherein the top-dead-center is referred to a top-dead-center between a compression stroke and a power stroke.

19. The crankshaft rotating angle controlling method of claim 13, wherein the bottom-dead-center is referred to a bottom-dead-center between a power stroke and an exhaust stroke.

20. The crankshaft rotating angle controlling method of claim 13, wherein the engine and the generator are co-axial.

21. The crankshaft rotating angle controlling method of claim 13, wherein the battery provides a current to drive the crankshaft to achieve or exceed the top-dead-center after the generator of the engine is set in the driving mode.

22. The crankshaft rotating angle controlling method of claim 21, wherein the specific value is determined by a torque that the crankshaft can achieve or exceed the top-dead-center and remaining inertia of the engine speed from the specific value to zero.

23. The crankshaft rotating angle controlling method of claim 13, wherein the generator in the standby mode is not driven or does not generate electric power.

24. The crankshaft rotating angle controlling method of claim 13, wherein the holding mode of the generator is referred to changing an order of three-phase Hall signals that are pulse-width modulated, and magnetic fields of the generator interlace temporarily.

25. The crankshaft rotating angle controlling method of claim 13, further comprising, after the generator is set in the holding mode, determining whether a number of seconds that the crankshaft is fixed in position when the generator is in the holding mode, is greater than a specific number of seconds, and setting the generator to be in the standby mode if the number of seconds is greater than the specific number of seconds.

* * * * *